US006097153A

United States Patent [19]

Brawley et al.

[11] Patent Number: 6,097,153

[45] Date of Patent: Aug. 1, 2000

[54] SUPERCONDUCTING ACCELERATOR CAVITY WITH A HEAT AFFECTED ZONE HAVING A HIGHER RRR

[75] Inventors: John Brawley, Grafton; H. Lawrence Phillips, Hayes, both of Va.

[73] Assignee: Southeastern Universities Research Assn.

[21] Appl. No.: 09/183,937

[22] Filed: Nov. 2, 1998

[51] Int. Cl.[7] ..... H05H 9/00

[52] U.S. Cl. ..... 315/5.41; 333/995; 505/866; 219/121.63

[58] Field of Search ..... 333/995; 315/5.41, 315/5.42; 505/866; 219/121.64, 121.63

[56] References Cited

U.S. PATENT DOCUMENTS 5,239,157 8/1993 Sakano et al. ..... 315/3.5 X 5,347,242 9/1994 Shimano et al. ..... 505/866 X

FOREIGN PATENT DOCUMENTS 159101 6/1996 Japan ..... 333/99 S

*Primary Examiner*—Justin P. Bettendorf

[57] ABSTRACT

An improved method for welding accelerator cavities without the need for time consuming and expensive faying surface treatments comprising electron beam welding such cavities in a vacuum welding chamber within a vacuum envelope and using the following welding parameters: a beam voltage of between about 45 KV and 55 KV; a beam current between about 38 ma and 47 ma; a weld speed of about 15 cm/min; and a sharp focus and a rhombic raster of between about 9 KHz and 10 Khz. A welded cavity made according to the method of the present invention is also described.

6 Claims, 1 Drawing Sheet

SUPERCONDUCTING ACCELERATOR CAVITY WITH A HEAT AFFECTED ZONE HAVING A HIGHER RRR

The United States of America may have certain rights to this invention under Management and Operating Contract DE-AC05-84ER40150 from the United States Department of Energy.

FIELD OF THE INVENTION

The present invention relates to superconducting high-frequency (RF) accelerator tube formed from niobium (Nb), and to an improved method for its manufacture.

BACKGROUND OF THE INVENTION

The use of Nb superconducting accelerator tubes in particle accelerators is well known in the art. A great deal of effort has been devoted to improving the manufacturing techniques used to produce such tubes because of their generally very high cost as dictated by the very stringent internal surface quality requirements which must be met to achieve optimum accelerator operating efficiency.

Superconducting RF accelerator cavities are commonly produced from preformed Nb half-cells joined together by welding. Currently, electron beam welding or EBW is the process of choice for this assembly step.

EBW is a violent process leaving a highly disturbed weld puddle with occasional voids, defects and a irregular surface texture. A surface irregularity can result in local magnetic field enhancement. If this enhancement causes the field to exceed a critical level, a so-called "normal" zone or region may occur, wherein the Nb undergoes a transition from the superconducting state to the normal conducting state. The propagation of such a "normal" zone is limited by the thermal conductivity (RRR) of the surrounding Nb. If the propagation of a "normal" zone is not stopped, the entire cavity may quench or become "normal" over all, or a substantial portion, of its surface. In this condition, the maximum accelerating field at which the cavity can operate will be significantly limited. These problems may be further compounded by the fact that the thermal conductivity of a solidified weld bead is often significantly reduced by the vacuum levels used in a typical electron beam welder.

In addition to the above potential problems which may be caused by weld defects, the EBW process tends to be very expensive primarily due to the high cost of precision machining of all faying surfaces to avoid the occurrence of weld defects. Previously used weld parameter sets have required a carefully machined edge in order to achieve a satisfactory weld. For example, in welding a cavity from 3 mm niobium, machined overlaps 1.5 mm thick were provided as the faying surfaces. Such edge preparation is extremely time consuming and expensive.

An ideal electron beam weld and welding process would therefore have the following properties:

1) It would provide reduced fabrication costs by having a high tolerance for variations in faying surface preparation, i.e. sheared edges having cracks, burrs and other irregularities could be used without further precision machining;
2) It would provide a very smooth weld surface on the inside of the cavity when welded from the outside in the presence of such irregularities; and
3) The process would raise rather than degrade the thermal conductivity of the weld bead and the surrounding heat affected zone.

SUMMARY OF THE INVENTION

The problems of high cost due to edge preparation and operating inefficiencies due to weld defects in electron beam welded niobium accelerator cavities have been solved, in accordance with the present invention, through the development of a new weld beam parameter set accompanied by improving the vacuum inside of the cavity during electron beam welding through the use of internal getter pumping afforded by the niobium vapor evolved at the weld during welding.

The method of the present invention produces a weld bead on the inner surface of the niobium cavity which is smooth and flat, even with no particular edge preparation other than the shearing required to produce the edge prior to welding. Additionally, the method of the present invention maintains or increases the thermal conductivity of the material in the weld bead and the heat affected zone even in electron beam welders having poor to moderate vacuums of less than $1\times10^{-6}$ Torr. The effect of this improved process is to provide a fabricated accelerator tube that increases the available accelerating field which can be attained before quench is achieved.

According to the present invention, the benefits just described are achieved by electron beam welding under vacuum using the following welding parameters:

Beam Voltage: 45 KV to 55 KV

Beam Current: 38 ma to 47 ma

Weld speed: 15 cm/min

Focus: Sharp

Rhombic Raster: 9 KHz and 10 KHz axes.

BRIEF DESCRIPTION OF THE DRAWINGS

The invention will be more fully understood from the following detailed description taken in conjunction with the accompanying drawing, which forms a part of this application and in which.

DETAILED DESCRIPTION OF PREFERRED EMBODIMENT

Figure 1:
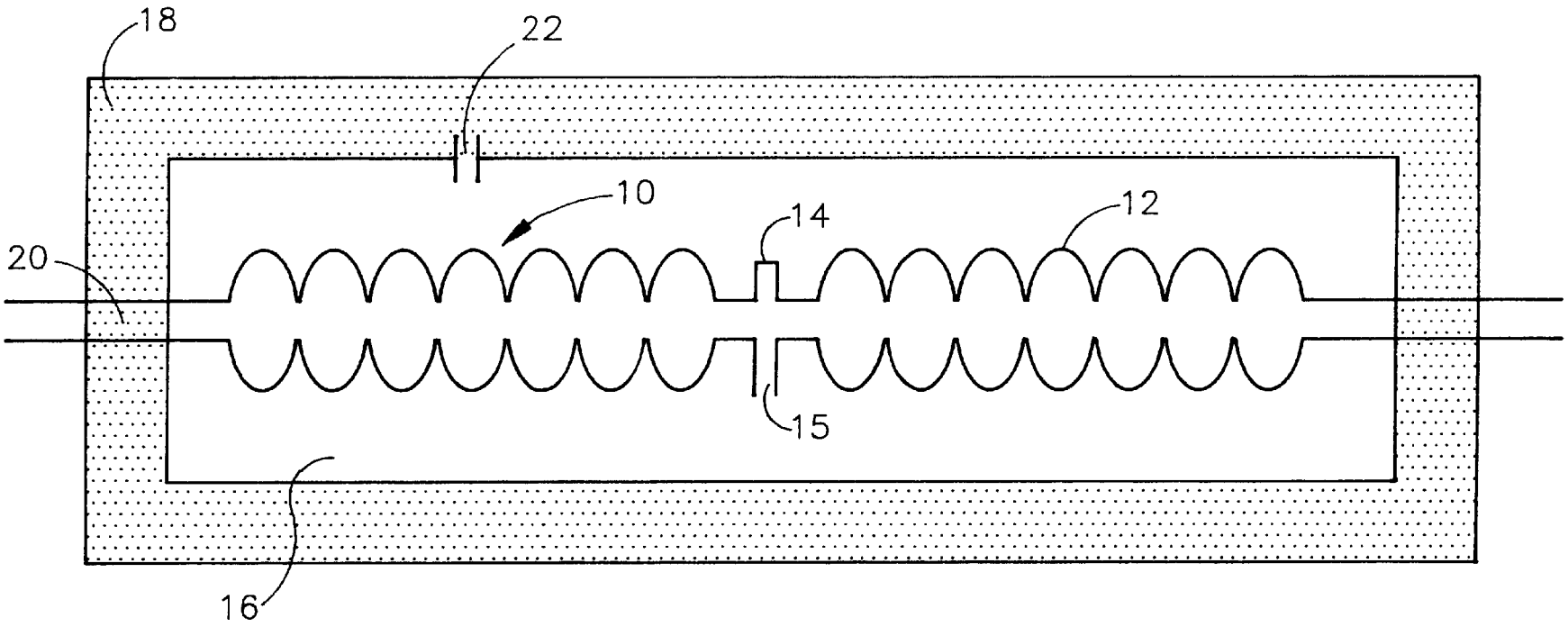
FIG. 1 is schematic drawing of the apparatus used to accomplish the welding method of the present invention.

According to the present invention, accelerator cavities of the type shown at 10 and 12 in FIG. 1 are welded together at point 14 using electron beam welding using a specified weld parameter set. Surprisingly, as will be shown in the example below, the use of this parameter set has been found to yield a weld having an increased rather than a decreased RRR at the weld site while obviating the need for any sophisticated and expensive edge preparation on the faying surfaces. As a consequence, the resulting welded cavity demonstrates quench properties at least equal to those of the parent niobium material.

Additionally, the use of a small, on the order of from about 0.75 square cm to about 1.25 square cm aperture to allow equalization of vacuum between the two welding cavity 16 and vacuum envelope 18, is preferably used.

The electron beam weld parameters used in accordance with the present invention are as follows:

Beam Voltage: 45 KV to 55 KV

Beam Current: 38 ma to 47 ma

Weld speed: 15 cm/min

Focus: Sharp

Rhombic Raster: 9 KHz and 10 KHz 10 KHz axes.

Welding is accomplished by improving the vacuum inside of the welding cavity, shown schematically at 16 in FIG. 1, during welding by using fixturing having very limited conductance between the inside and the outside of the welding cavity 16 through the use of a vacuum envelope 18. In such a configuration, vacuum on the welded cavities 10 and 12 is achieved by drawing the vacuum through extension 20 of cavity 10. Hole 22 provides limited conductance, on the order of about 11 Torr-liters/second between vacuum envelope 18 and welding cavity 16. It is conjectured, that such an arrangement provides internal getter pumping of the niobium vapor generated at the weld as it deposits on neighboring cooler surfaces in the area of the weld as explained more fully below.

The relatively low weld speed provides a relatively high level of evaporated niobium forming a fresh unoxidized surface on the inner walls of the cavities being welded as well as a large heat affected zone around the weld path. As the weld proceeds, the high cavity wall temperature enhances diffusion of gases from the bulk of the niobium to the cavities 10 and 12 where it is in turn pumped by the niobium film on the cooler cavity walls. The available pumping speed per unit area for active metal films such as niobium is typically of the same order of magnitude as the conductance of the open aperture between the vacuum spaces at weld point 14. Since the area of niobium film on the inner surface of cavities 10 and 12 is several orders of magnitude greater than that in aperture 15, a corresponding reduction in pressure in cavity vacuum, i.e. in cavities 10 and 12, over the vacuum, in welding cavity at 16, can be achieved. As the cavity walls cool down, significant diffusion will stop and a gas density gradient between the outer and inner cavity wall surfaces will be frozen leaving the inner surface with a smooth surface and, as shown below, a higher RRR than the outer surface. Any contaminated niobium film on the internal wall is removed, after welding, using a buffered chemical polish (BCP). BCP is well known in the art and is a solution of equal parts of phosphoric, hydrofluoric and nitric acids.

EXAMPLE

In order to demonstrate the process of the present invention, a 1500 MHz cell is formed from 3 mm niobium sheet having an RRR of 200. The half cell edges are trimmed in a milling machine without deburring. Both half cells are cleaned with BCP for one minute before welding. A cylindrical electron beam weld is then performed in a continuous load-locked electron beam weld chamber as shown in FIG. 1 under a vacuum of $1\times10_{-8}$ Torr using the following weld parameters:

Beam Voltage: 50 KV

Beam Current: 43 mA

Weld Speed: 15 cm/min

Focus: Sharp

Rhombic Raster: 9 KHz and 10 KHz and 10 axes.

The welder contains three automated guns (not shown) operating simultaneously in the vacuum chamber which is never permitted to rise to atmospheric pressure. The cylindrical chamber is about 15 m in length with a load lock at each end. After welding, the complete, welded assembly is etched with BCP for a total of twelve minutes in four successive 3 minute exposures.

In testing after fabrication, the field is found to be limited by quench at a peak field of 39.2 MV/m. Most surprising, the niobium in the area of the weld demonstrates an RRR (thermal conductivity) of about 500 instead of the RRR of 200 of the starting or parent material. As described above, it is characteristic of weld joints that their RRR is reduced from that of the parent material rather than increased, and that such decrease in RRR results in the propagation of a "normal" zone with the concommittant increase in the tendency of the cavity to quench at lower power levels, thus, reducing the accelerating field which the cavity is able to generate.

Measurement of RRR in this example is accomplished by the eddy current method described in "The Eddy Current Method for RRR Measurement of Superconductive Materials", W. Singer and D. Proch, Proceedings of the Seventh Workshop on RF Superconductivity, Volume 2, Edited by B. Bonin, pgs. 547–549", held Oct. 17–20, 1995 at Gif sur Yvette, France. This eddy current technique involves two concentric coils situated close to the metallic specimen. A current with a definite frequency is established in the primary coil from a frequency generator. The alternating magnetic field in the primary coil induces eddy current in the metal, the value and penetration depth of which depend on the electrical conductivity of the sample. This eddy current itself creates a magnetic field that induces a signal in the secondary (pick up) coil. This signal is a function of the material's electrical conductivity and it can be registered on appropriate magnetic field detection and recording devices.

The density of the eddy current is maximal on the metal surface in the contour with a diameter closest to the diameter of the primary coil and decreases with deepening of the signal into the object. Generally, for electromagnetic field penetration depth into a nonmagnetic metal the following formula is valid:

$$\delta=k.503$$

$$f.\alpha$$

where $\delta$ is the penetration depth in centimeters, f is the frequency in Hz, $\alpha$ is the electrical conductivity in MS/m, k is greater than 1 i.e. the coil shape dependent factor.

The electronic equipment used for this measurement consists of a frequency generator, a lock-in amplifier, a digital voltmeter, and an oscillograph. Measurement is computer-controlled under the graphical programming language LabView 3. Two identical pickup coils with contrarily directed magnetic fields are applied for elimination of the inductive voltage that is created by the primary coil in the pickup coil when the sample is absent.

From the traditional 4-point residual resistivity ratio (RRR) measurement, it is well known that firstly the resistivity of niobium with different purity remains nearly constant at room temperature and secondly the abrupt change in resistivity at the temperature of the superconductive transition (Tc jump) is bigger the smaller the residual resistivity value. This behavior can be assumed as a basis for residual resistivity ratio, eddy current measurement. In principle, the measurement of the superconductive jump (Tc jump) in the signal amplitude is enough for the residual resistivity ratio quantification.

In practice, it is reasonable to obtain the required the residual resistivity ratio value from a previously created calibration curve and standard samples are readily available for this purpose.

A profilometer trace over the weld surface shows an average surface roughness of about 3.2 microns.

From the foregoing, it can be seen that the electron beam welding method of the present invention produces a welded cavity assembly that clearly demonstrates physical characteristics, RRR and smoothness, superior to those demonstrated by electron beam welded cavities produced by prior art methods.

From the foregoing description, one skilled in the art can easily ascertain the essential characteristics of this invention, and without departing from the spirit and scope thereof, make various changes and modifications of the invention to adapt it to various usages and conditions. It is therefore intended that the scope of the invention be limited only by the scope of the appended claims.

What is claimed is:

1. A superconducting accelerator cavity comprising at least a pair of niobium cavities welded together and having a heat affected zone at the point where said cavities are welded together wherein the heat affected zone has a residual resistivity ratio higher than that of the niobium cavities in areas outside of said heat affected zone.

2. The superconducting accelerator cavity of claim 1 produced by a method comprising:

a) fixturing a pair of cavities to be welded in a vacuum chamber within a vacuum envelope; and b) electron beam welding the cavities to be welded using the following welding parameters:

Beam Voltage: 45 KV to 55 KV

Beam Current: 38 ma to 47 ma

Weld Speed: 15 cm/min

Focus: Sharp

Rhombic Raster: 9 KHz and 10 Khz axes.

3. The superconducting cavity of claim 2 wherein an aperture providing conductance of about 11 Torr-liters per second is provided between said vacuum chamber and said vacuum envelope.

4. The superconducting cavity of claim 3 wherein the cavities are etched in buffered chemical polish prior to welding.

5. The superconducting cavity of claim 4 wherein the cavities are etched in buffered chemical polish for about 12 minutes after welding.

6. The superconducting cavity of claim 2 wherein the electron beam welding parameters are as follows:

Beam Voltage: 50 KV

Beam Current: 43 mA

Weld Speed: 15 cm/min

Focus: Sharp

Rhombic Raster: 9 KHz and 10 KHz axes.

* * * * *